US005657653A

United States Patent [19]

Hensley et al.

[11] Patent Number: 5,657,653

[45] Date of Patent: Aug. 19, 1997

[54] DUAL LOCK WITH SIMULTANEOUS RETRACTION OF LATCH AND DEADBOLT BY INSIDE LEVER AND UNCOULPLER BETWEEN DRIVING SPINDLE AND THE LEVER

[75] Inventors: Frederick M. Hensley; Gary A. Dehn; Dario L. Pompeii; Jeffrey G. Towles, all of Colorado Springs, Colo.

[73] Assignee: Schlage Lock Company, San Francisco, Calif.

[21] Appl. No.: 513,497

[22] Filed: Aug. 10, 1995

[51] Int. Cl.[6] ..... E05B 13/10

[52] U.S. Cl. ..... 70/224; 70/222; 70/107; 292/DIG. 62

[58] Field of Search ..... 70/224, 107, 472, 70/473, 153, 221, 222, 134; 292/169.21, 169.23, 336.5, DIG. 62, 92

[56] References Cited

U.S. PATENT DOCUMENTS

| | | | |
|---|---|---|---|
| 568,638 | 9/1896 | Sweet . | |
| 831,386 | 9/1906 | Simmons . | |
| 840,007 | 1/1907 | Mullikin | 70/DIG. 42 |
| 1,060,251 | 4/1913 | Hagstrom . | |
| 1,459,290 | 6/1923 | Habenicht . | |
| 1,495,820 | 5/1924 | Tierney . | |
| 2,182,307 | 12/1939 | Behnke | 70/80 |
| 2,207,143 | 7/1940 | Brauning | 70/221 |
| 2,651,934 | 9/1953 | Chesler | 70/DIG. 42 |
| 2,998,274 | 8/1961 | Russell | 292/169.22 |
| 3,390,558 | 7/1968 | Tornoe et al. | 70/107 |
| 3,683,652 | 8/1972 | Halopoff et al. | 70/146 |
| 3,791,180 | 2/1974 | Doyle | 70/107 |
| 3,999,789 | 12/1976 | Maurits et al. | 70/107 |
| 4,129,019 | 12/1978 | Urdal | 70/107 |
| 4,276,760 | 7/1981 | Nolin | 70/110 |
| 4,345,449 | 8/1982 | Mullich | 70/153 |
| 4,418,552 | 12/1983 | Nolin | 70/107 |
| 4,563,885 | 1/1986 | Madden | 70/97 |
| 4,594,864 | 6/1986 | Hart | 70/143 |
| 4,606,203 | 8/1986 | Esser | 70/107 |
| 4,671,089 | 6/1987 | Fleming et al. | 70/452 |
| 4,741,190 | 5/1988 | Miller | 70/DIG. 42 |
| 4,784,417 | 11/1988 | Fleming et al. | 292/347 |
| 4,809,526 | 3/1989 | Shen | 70/107 |
| 4,813,723 | 3/1989 | Anderson et al. | 292/336.3 |
| 4,838,053 | 6/1989 | Shen | 70/92 |

(List continued on next page.)

FOREIGN PATENT DOCUMENTS

| | | | |
|---|---|---|---|
| 834448 | 2/1970 | Canada | 70/107 |
| 698255 | 2/1930 | France | 70/221 |

*Primary Examiner*—Darnell M. Boucher

*Attorney, Agent, or Firm*—Robert F. Palermo; Michael H. Minns

[57] ABSTRACT

In a door lock having a latch bolt selectively retractable by a rotatable driver spindle, the driver spindle being rotatable by operation of an outside manual lever associated with an outside chassis assembly or by operation of an inside manual lever associated with an inside chassis assembly, a lost motion mechanism is provided between the driver spindle and the inside chassis assembly so that rotational movement of the driver spindle is not transmitted to the inside lever. An interconnect mechanism connects the inside lever to a deadbolt operating assembly whereby operation of the inside lever retracts both the latch bolt and the deadbolt. The lost motion mechanism includes a driven spindle located within an axially extending bore in a spindle core and having an opening for receiving an end of the driver spindle, the spindle core being mechanically linked to the inside lever. The driven spindle and core are configured such that rotational movement of the spindle core is transmitted to the driver spindle but rotational movement of the driver spindle and driven spindle is not transmitted to the spindle core. The interconnect mechanism includes a lower cam driven by the spindle core for moving a slide plate, and an upper cam mounted on an operating bar which is rotated to retract or extend the deadbolt. As the lower cam is rotated, it moves the slide plate which is configured to receive and rotate the upper cam so that the operating bar retracts the deadbolt.

17 Claims, 8 Drawing Sheets

U.S. PATENT DOCUMENTS

| | | | |
|---|---|---|---|
| 4,866,965 | 9/1989 | Urdal | 70/481 |
| 4,979,767 | 12/1990 | Lin | 70/107 |
| 5,020,343 | 6/1991 | Hart et al. | 70/473 |
| 5,029,914 | 7/1991 | Hankal | 292/DIG. 62 |
| 5,077,992 | 1/1992 | Su | 70/107 |
| 5,177,987 | 1/1993 | Shen | 292/336.3 |
| 5,193,370 | 3/1993 | Norden | 70/DIG. 42 |
| 5,335,950 | 8/1994 | Mirshafiee et al. | 292/169.23 |
| 5,492,380 | 2/1996 | Smallegan et al. | 292/336.3 |
| 5,496,082 | 3/1996 | Zuckerman | 292/336.3 |
| 5,513,505 | 5/1996 | Dancs | 70/107 |

| Fig. 1A | Fig. 1B |
|---|---|

DUAL LOCK WITH SIMULTANEOUS RETRACTION OF LATCH AND DEADBOLT BY INSIDE LEVER AND UNCOULPLER BETWEEN DRIVING SPINDLE AND THE LEVER

FIELD OF THE INVENTION

This invention relates to high security door locks for locking doors to secured areas. More particularly, the invention relates to dual locks having a latch bolt and a deadbolt which may be separately locked but simultaneously retracted by an inside lever to permit rapid egress from the secured area regardless of the locked/unlocked state of either the latch bolt or the deadbolt.

BACKGROUND OF THE INVENTION

It is known to provide door locks with a latch bolt lock, a deadbolt lock and a mechanism interconnecting the latch bolt and deadbolt so that in an emergency both bolts may be simultaneously retracted upon operation of a single actuating means provided on the inside of a door thereby permitting rapid egress from a secured area. Generally speaking however, it has not been the usual practice to interconnect a so-called "tubular" lock with a deadbolt lock because tubular locks usually have a single common rectangular driving spindle for the inside and outside lock chassis. Therefore, interconnection of the latch bolt to the deadbolt allowed rotation of the outside or inside knob or lever to retract the deadbolt. Obviously, retraction of the deadbolt from outside of the secured area without a deadbolt key is not desirable.

Furthermore, known mechanisms for interconnecting a latch bolt to a deadbolt for simultaneous operation tend to be complex. Known devices employ gears, levers and springs in complex configurations. The arrangements are such that adaptation of the locks for right-handed or left-handed operation is difficult or impossible.

SUMMARY OF THE INVENTION

An object of the present invention is to provide a tubular lock having a latch bolt and a deadbolt both retractable in response to a single manual actuator located on the inside of the door.

A further object of the invention is to provide a lock wherein the latch bolt is selectively retracted by rotation of a driver which extends between an outside chassis assembly having an outside manual actuator and an inside chassis assembly having an inside manual actuator. Rotation of either actuator rotates the driver. However, a lost motion mechanism located in the inside chassis assembly prevents rotational movement of the driver from being transmitted to the inside chassis assembly.

Still another object of the invention is to provide an interconnect mechanism for interconnecting a latch bolt and a deadbolt whereby rotation of an inside manual actuator associated with an inside chassis assembly causes retraction of both the latch bolt and the deadbolt. The interconnect mechanism comprises a lower cam rotatable in response to an inside manual lever, a slide plate driven by the lower cam in a direction parallel to the door and an upper cam mounted on a rotatable operating bar, the operating bar driving a deadbolt operating assembly to retract the deadbolt.

Another object of the invention is to provide a tubular lock as described above wherein the lost motion mechanism is located in the inside chassis assembly and comprises a generally cylindrical driven spindle rotatably disposed within a generally cylindrical spindle core. The spindle core has an outwardly extending projection for driving the lower cam of the interconnect mechanism as the inside hand lever is turned. A driver extends between, and is rotatably driven by, an outside chassis assembly. One end of the driver extends into an opening in the driven spindle. The interior of the spindle core is provided with abutments and the exterior of the driven spindle is provided with projections. When the inside hand lever is turned, motion is transmitted through the lost motion mechanism to rotate the driver which in turn retracts the latch bolt. When the outside handle is turned, the driver retracts the latch bolt but the lost motion mechanism prevents rotation of the driver from being transmitted to the spindle core and the lower cam of the interconnect mechanism.

Other objects of the invention and the manner of making and using it will become evident from the following description and the accompanying drawings.

DESCRIPTION OF PREFERRED EMBODIMENTS

The present invention is suitable for use on either right or left handed doors. To simplify the description and the drawings, the invention is described herein as if mounted on a right hand door, that is, a door which is hinged on the right side as viewed from the outside of the area being secured.

Figures 1A, 1C:
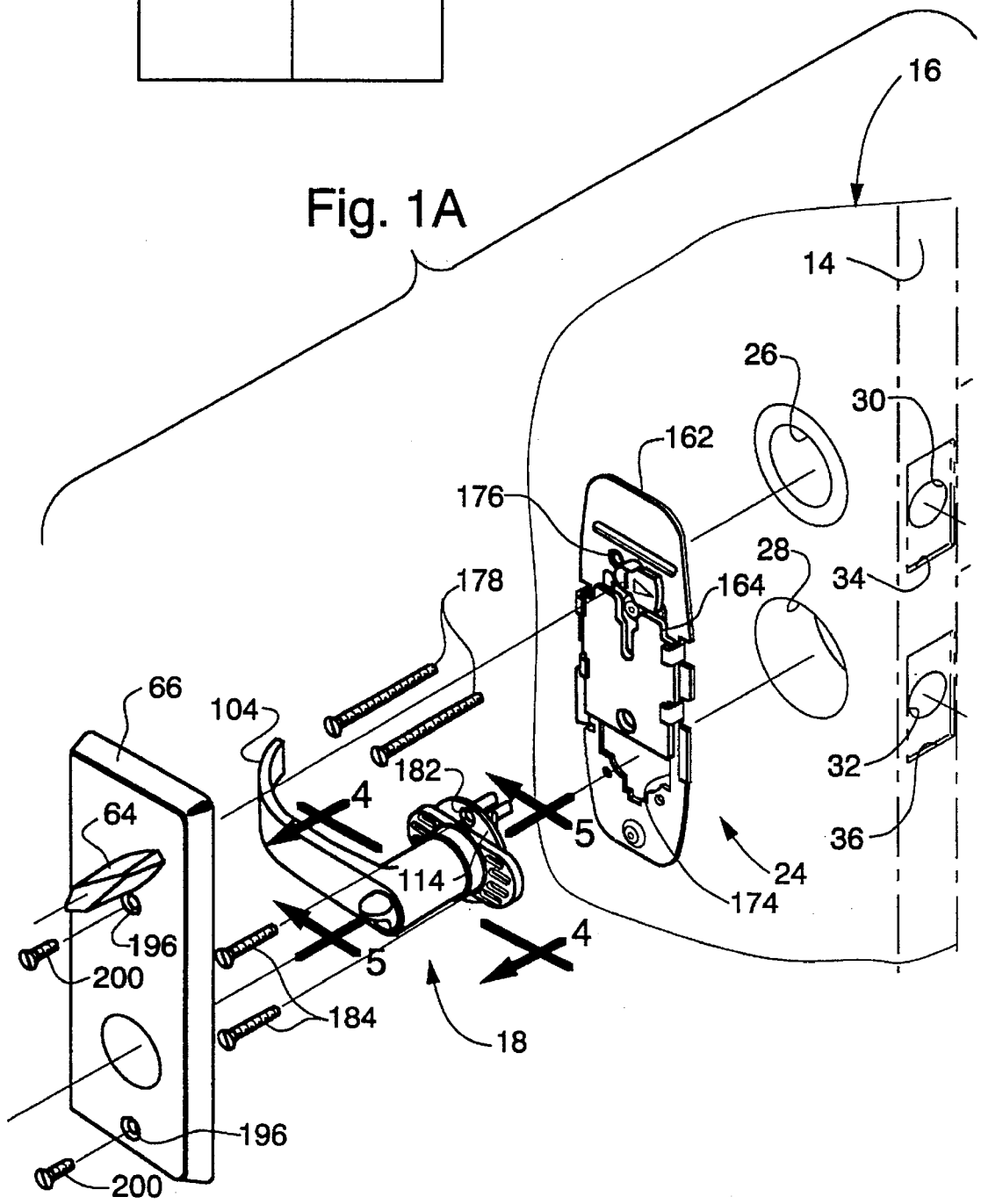
FIGS. 1A and 1B, when arranged as shown in FIG. 1C, comprise an exploded perspective view of a door lock according to the present invention.
Figure 1B:
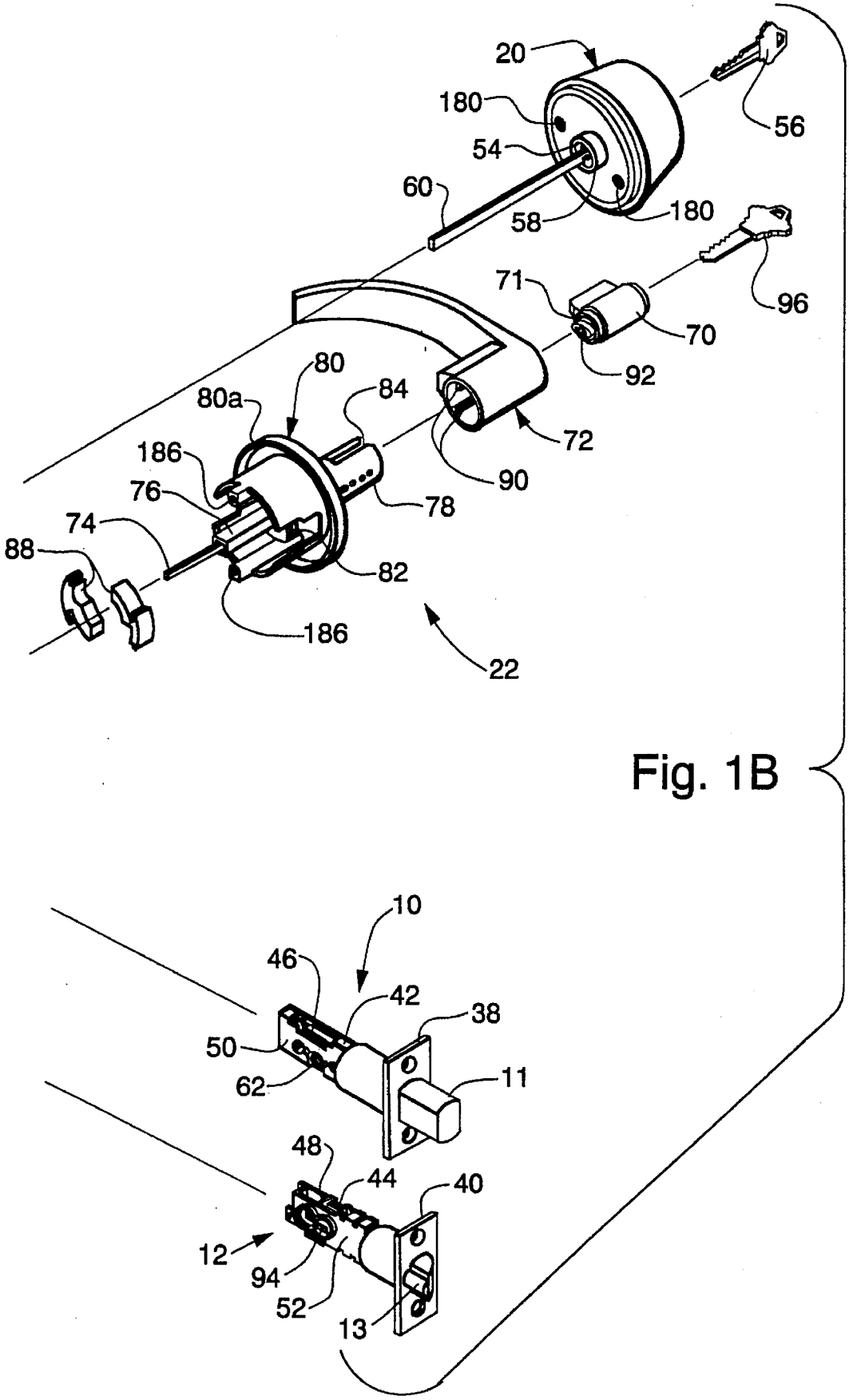

In FIGS. 1A and 1B, a security lock includes a deadbolt operating assembly 10 for extending or retracting a deadbolt 11 and a latch bolt operating assembly 12 for retracting a latch bolt 13 into an edge surface 14 of a door 16, an inside chassis assembly 18 located on the inside of door 16, that is, on the side of the door facing the area being secured, a deadbolt lock assembly 20 and an outside chassis assembly 22 both mounted to the outside of the door, and an interconnect mechanism 24 for interconnecting operation of the deadbolt 11 and latch bolt 13. Door 16 is prepared in a conventional manner for receiving the lock by providing upper and lower openings 26, 28 extending through the door between the inside and outside door surfaces, and two holes 30, 32 extending from edge surface 14 to the openings 26, 28, respectively. The edge surface 14 is provided with recesses 34, 36 to permit recessing of the face plates 38, 40 through which deadbolt 11 and latch bolt 13, respectively, extend.

Deadbolt operating assembly 10 extends through hole 30 to opening 26 and latch bolt operating assembly 12 extends through hole 32 to opening 28. The deadbolt and latch bolt operating assemblies 10, 12 are conventional. Each includes a pivotable cam or lever 42, 44 which moves an operating slide 46, 48, the slides being slidable in frames 50, 52, respectively. The deadbolt operating slide 46 is coupled to deadbolt 11 so that as deadbolt lever 42 is pivoted to move slide 46 back and forth, the deadbolt is retracted within the door or extended beyond edge surface 14 of the door. The latch bolt 13 and operating slide 48 are biased by a spring (not shown) so that latch bolt 13 normally extends outwardly beyond the door surface 14 except when latch lever 42 is pivoted to move the slide 48 toward opening 28. A spring (not shown) acts against lever 42 to drive the deadbolt 11 to the fully retracted or fully extended position once the lever 42 has been pivoted past a center position.

The deadbolt lock assembly 20 is conventional. It includes a lock plug 54 into which a key 56 may be inserted and turned through an angle of about 270°. One end of the lock plug is provided with a recess 58 for receiving one end of deadbolt operating bar 60. The operating bar 60 is rectangular or non-circular in cross-section (see FIGS. 6 and 8) and recess 58 is generally circular but has two abutments for engaging the sides of the operating bar. The arrangement acts as a lost motion link permitting the key 56, when at either limit of its rotation range, to turn lock plug 54 through about 180° before the lock plug engages a side of the operating bar to cause its rotation. When the assembly 20 is mounted on the door, the deadbolt operating bar 60 extends through a rectangular opening 62 in lever 42 of the deadbolt operating assembly 10. As key 56 is turned in one direction the operating bar 60 rotates in one direction thereby pivoting lever 42 in one direction to extend deadbolt 11, and as key 56 is turned in the opposite direction the operating bar rotates in the opposite direction to pivot lever 42 in the opposite direction and retract the deadbolt.

The deadbolt operating bar 60 extends through door 16 via opening 26. A thumb turn 64 is mounted for rotation in an escutcheon plate 66. The thumb turn is provided with two slots 68 (FIG. 8) intersecting at a 90° angle and when the escutcheon plate is mounted on the inside of the door an end of the operating bar 60 extends into one of the slots. Thus, the deadbolt 11 may be extended or retracted by turning thumb turn 64 to rotate the operating bar 60.

The outside chassis assembly 22 comprises a lock cylinder 70 and lock plug 71 which are received into an outside hand lever 72, a latch lock bar 74 having a rectangular or non-circular cross-section, a hollow and generally rectangular tubular driver 76 through which the lock bar 74 extends, a spindle 78 rotatably mounted in a housing 80, a torsion spring 82 and two rotation stops 88. The arrangement and operation of assembly 22 is conventional. Lock bar 74 extends through an element of a clutching mechanism (not shown) and the spindle 78 to the lock plug 71 where it fits into a recess 92 in an end face of the lock plug. Spindle 78 has two slots 84, one of which is visible in FIG. 1B. Slots 84 engage two internal ribs 90 on the hand lever 72 so that as the hand lever is turned it rotates spindle 78. Rotation stops 88 limit the degree of rotation of hand lever 72 and also its direction of rotation. Torsion spring 82, which is arranged in a cage like the spring 126 subsequently described with reference to FIGS. 2A–2B, returns the hand lever to its initial position when the hand lever is released. Spindle 78 drives the driver 76 through the clutching mechanism when the hand lever is turned.

The stops 88 are reversibly positionable to act against the cage in which torsion spring 82 is retained so that when the hand lever 72 is not locked it will rotate only clockwise or counter-clockwise in response to an applied force. The positioning of stops 88 is chosen according to the handing of the door.

When a key 96 is inserted into lock plug 71, the key may be turned 90° in one direction to rotate the lock plug and lock hand lever 72 against rotation, or 90° in the opposite direction to unlock the hand lever. The lock plug in turn rotates lock bar 74. Key 96 may be turned through 180° but the recess 92 in the end face of the lock plug allows 90° of lost motion so that the lock bar will rotate through 90° to move between the locked and unlocked conditions. The lock bar 74 acts through the clutching mechanism to lock spindle 78 and lever 72 against rotation or permit rotation. The clutching mechanism disconnects the spindle 78 from driver 74 so that driver 76 may rotate as subsequently described even though the spindle and hand lever 72 are locked against rotation.

The outside chassis assembly 22 is mounted on door 16 from the outside with the housing 80 extending into opening 28 in the door. The lock bar 74 and tubular driver 76 extend through a rectangular slot 94 in latch lever 44 and into the inside chassis assembly 18 on the inside of the door. When hand lever 72 is turned to rotate driver 76, the driver pivots latch lever 44 thereby retracting latch bolt 13. When the hand lever 74 is released, torsion spring 82 returns the hand lever to a home position and a compression spring (not shown) in assembly 12 returns the latch bolt 13 to the extended position shown in FIG. 1B.

Figure 3:
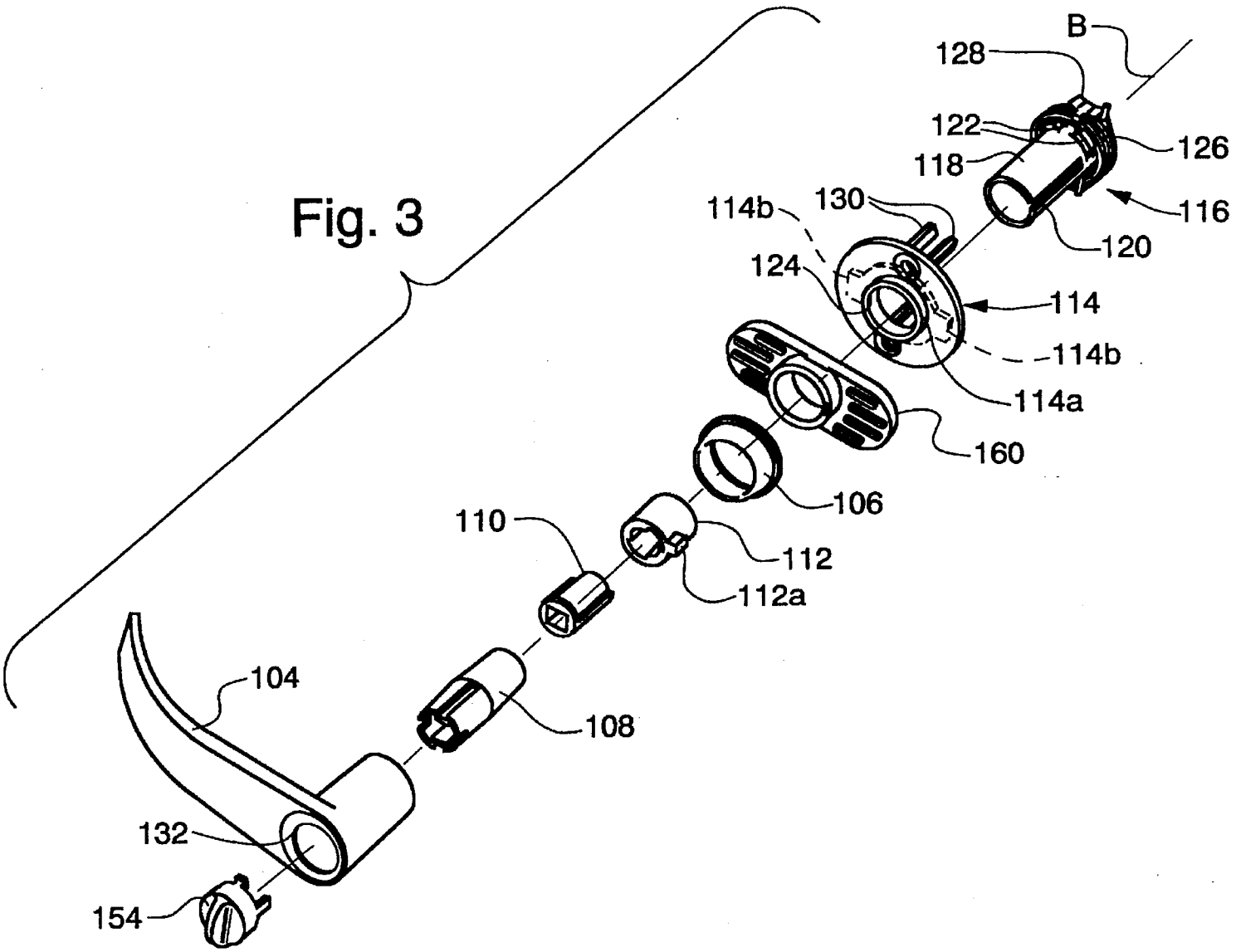
FIG. 3 is an exploded perspective view of an inside chassis assembly.
Figure 4:
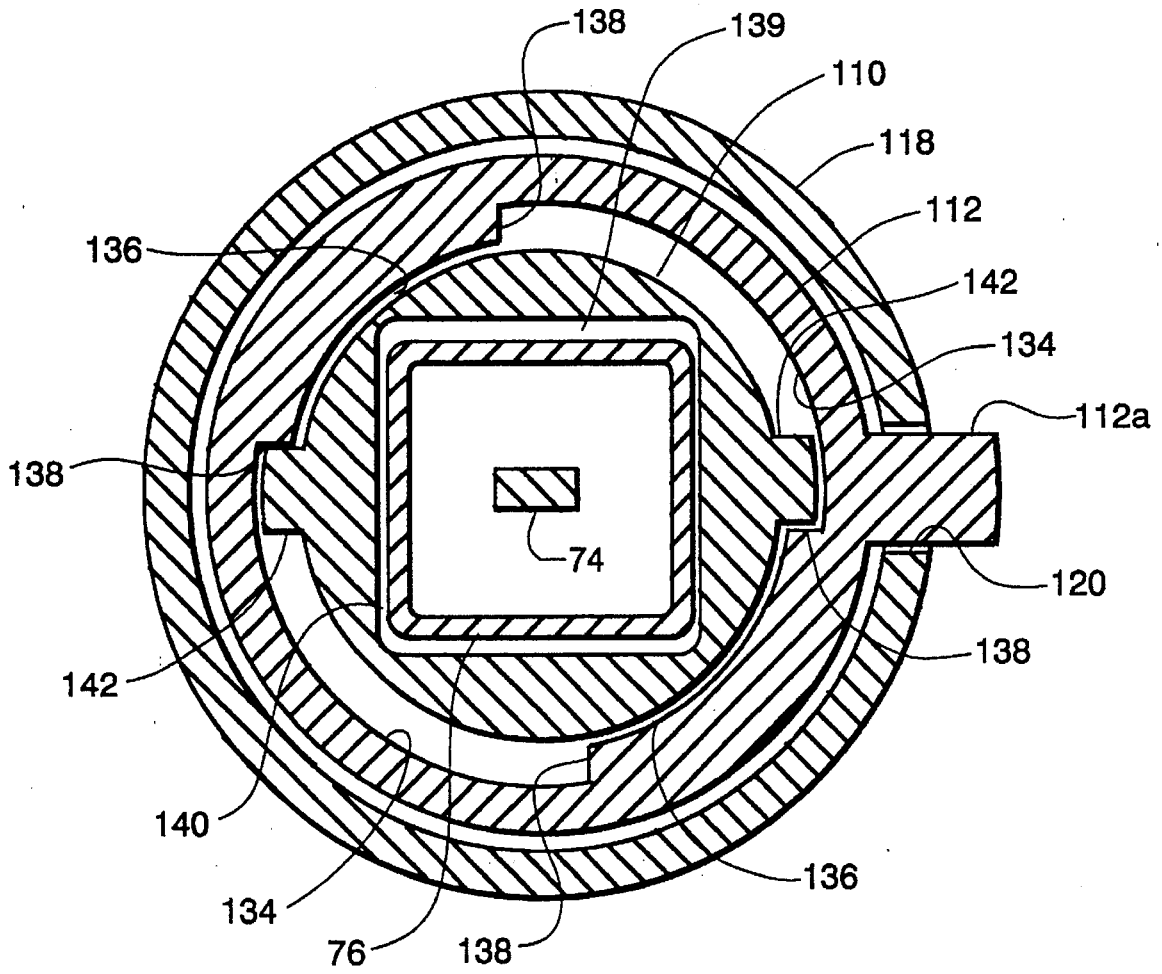
FIG. 4 is a sectional view, taken along the line 4—4 of FIG. 1A showing the outside spindle, spindle core, driven spindle, driving spindle and latch lock bar.
Figure 5:
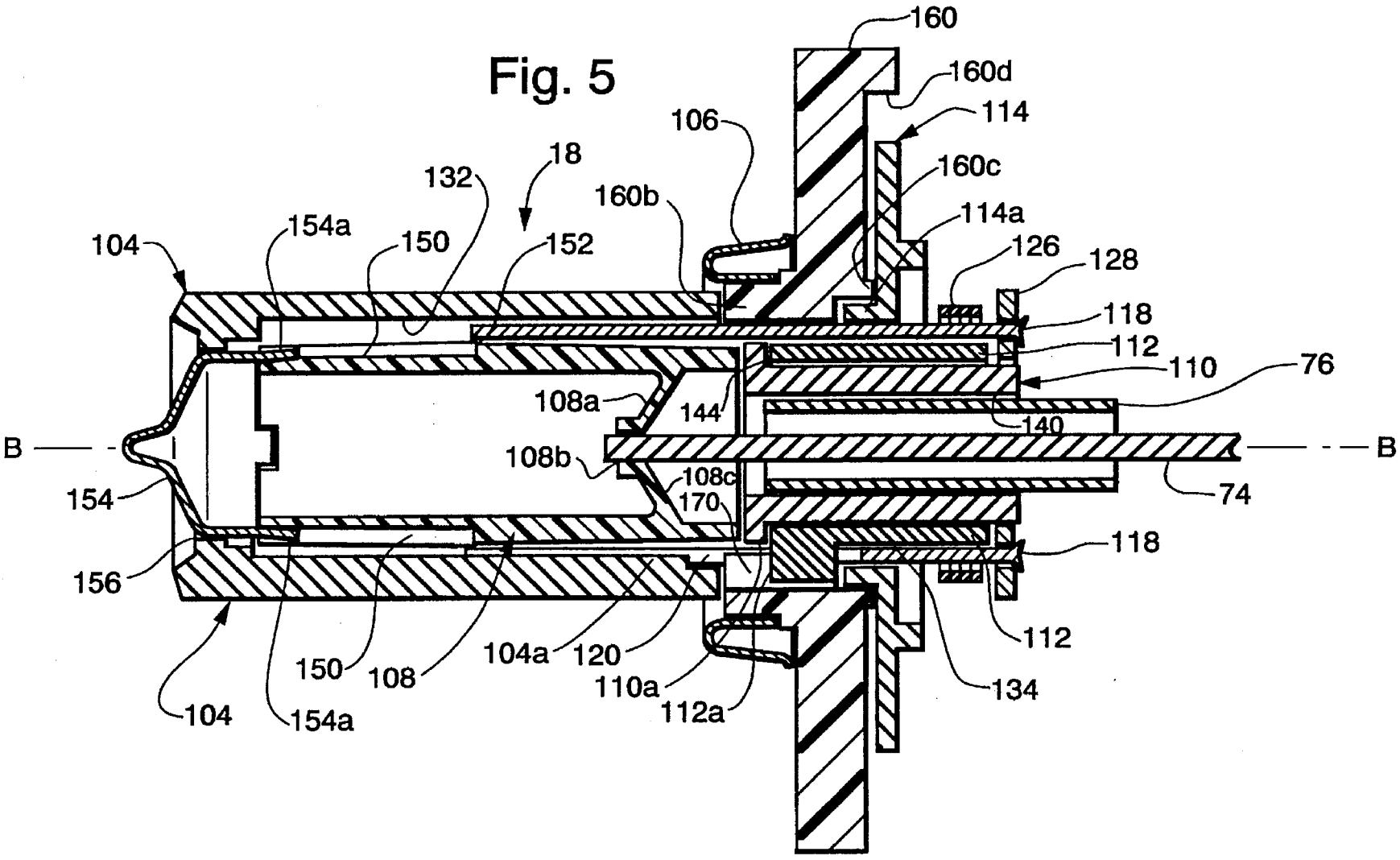
FIG. 5 is a sectional view of the inside chassis assembly taken along the line 5—5 of FIG. 1A, showing the components of the inside chassis assembly when the inside handle is operated to retract the latch bolt.

The lock bar 74 and driver 76 extend into the inside chassis assembly 18 as shown in FIG. 5. In accordance with one aspect of the present invention, and as shown in FIGS. 3–5, the inside chassis assembly comprises an inside hand lever 104, a shroud 106, a button bracket 108, a driven spindle 110, a spindle core 112, a handing plate 114 and a spindle assembly 116.

Figure 2B:
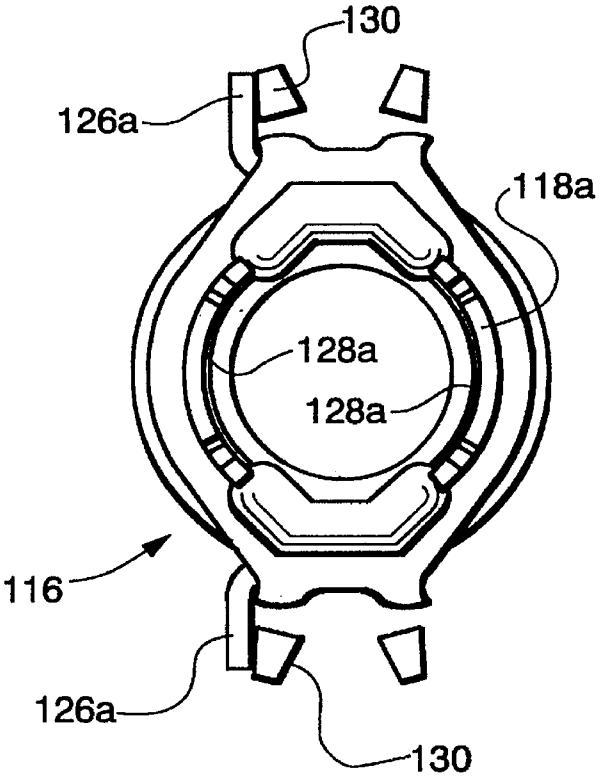
FIG. 2B is a right side view of the spindle cage assembly of FIG. 2A.
Figure 2A:
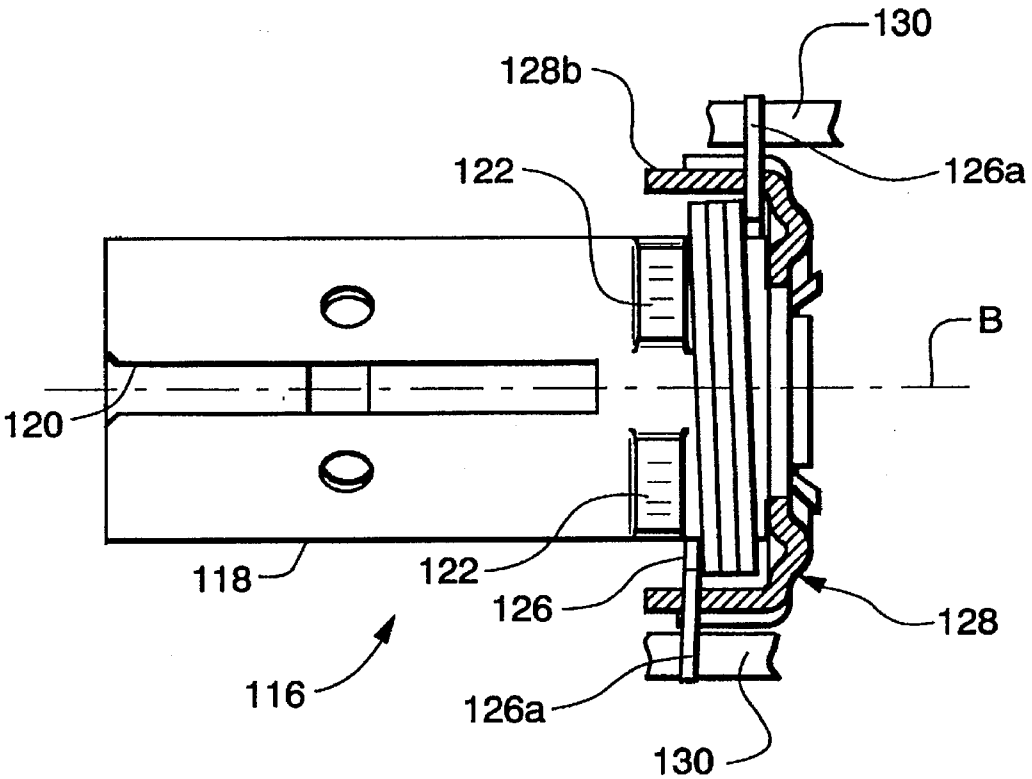
FIG. 2A is a front elevation view of a spindle cage assembly, the cage being shown in section.

As shown in FIGS. 2A–2B, the spindle assembly 116 includes an outer spindle 118 having a longitudinal slot 120 extending along a portion of the length thereof, and four projections or ridges 122, only two of which are visible in FIG. 2A. The outer spindle 118 extends through an opening 124 (FIG. 3) in handing plate 114 and projections 122 engage the handing plate around the periphery of the opening to limit movement of the spindle leftward as viewed in FIG. 5.

The spindle assembly 116 also incudes a torsion spring 126 surrounding outer spindle 118 and a spindle cage 128 for securing the torsion spring on the outer spindle. One end of outer spindle 118 is provided with two arcuate and longitudinally extending ears or extensions 118*a* (FIG. 2B) and cage 128 is provided with two slots 128*a* through which the ears extend. The ears are staked to mechanically lock the spindle cage on the end of the outer spindle. Spindle cage 128 has two arms 128*b* extending generally parallel to the axis B of the inside chassis assembly. Torsion spring 126 is shaped to have two radially outwardly extending end portions 126*a* which engage and apply a bias force against arms 128*b*. When the spindle cage assembly is mounted in the opening 124 in handing plate 114, spring end portions 126*a* also engage two posts 130 projecting from the side of handing plate 114 facing the door.

The hand lever 104 has an axially extending opening 132 (FIG. 5) into which spindle 118 extends, and a longitudinally extending rib or key 104*a* extends along the interior wall of the hand lever surrounding the opening. Rib 104*a* is received into slot 120 of spindle 118 as the spindle is inserted into the hand lever. During assembly of the inside chassis assembly the hand lever 104 is also staked to the spindle 118 to prevent axial movement of the hand lever relative to the spindle.

Turning of the hand lever 104 rotates spindle 118 and cage 128. As the cage rotates, one of the cage arms 128*b* (FIG. 2A) acts against one of the spring end portions 126*a* thereby moving it away from one of the posts 130. The other end portion of the spring is prevented from moving by the other post 130 because the handing plate 114 is fixed relative to the door as subsequently described. Therefore, as hand lever 104 is turned, the spring 126 is wound up so as to store energy, and when the hand lever is released the stored energy returns the hand lever, outer spindle 118 and spindle cage 128 to their initial position.

The spindle core 112 is generally cylindrical and has an outside diameter slightly less than the internal diameter of outer spindle 118 so as to slidably fit into the outer spindle. A projection or key 112*a* (FIGS. 3, 4 and 5) extends outwardly from the cylindrical portion of the spindle core at one end thereof. Projection 112*a* is received into slot 120 of outer spindle 118 as the spindle core 112 is inserted into the spindle. When outer spindle 118 rotates about axis B, the spindle acts against projection 112*a* so that the spindle core rotates with the outer spindle.

An opening 134 extends axially through the spindle core 112, the opening being of irregular shape in cross-section as shown in FIG. 4. The interior wall surrounding opening 134 has two radially inwardly extending arcuate ribs 136. Ribs 136 extend the entire axial length of the core spindle and the end surfaces of the ribs that extend parallel to the axis of the spindle core form two pairs of abutments or stops 138, 138'.

Driven spindle 110 is a generally cylindrical element having a rectangular opening 139 (FIG. 4) bounded by an interior wall 140. The opening 139 extends axially throughout the length of the driven spindle. The cylindrical portion of the driven spindle 110 has a diameter slightly less than the diameter of the arcuate ribs 136 of the spindle core 112 so that the driven spindle rotates freely within the spindle core. Two ribs 142 project radially outwardly from the cylindrical surface of the driven spindle 110 so that the ribs may engage abutments 138 or 138' on spindle core 112 when the driven spindle is rotated within the spindle core. Ribs 142 extend over the entire axial length of the driven spindle.

Abutments 138, 138' on the spindle core 112 are spaced 90° apart thus allowing the driven spindle about 87° of rotational movement within spindle core 112 before a projection 142 comes into driving engagement with an abutment 138 or 138'.

The driven spindle 110 is provided with a circumferential rib or projection 110*a* (FIG. 5) extending radially outwardly at one end of the driven spindle. Projection 110*a* engages the end surface 144 of spindle core 112 thereby preventing the driven spindle 110 from sliding out the spindle core to the right as viewed in FIG. 5.

The driven spindle 110 and spindle core 112 comprise an uncoupler or lost motion mechanism which causes the driver 76 to be rotated when outer spindle 118 and inside hand lever 104 affixed thereto are rotated, but permits driver 76 to be rotated almost 90° by rotation of outside hand lever 72 without rotating outer spindle 118 and inside hand lever 104. Referring to FIGS. 1A, 1B and 4, as the outside hand lever 72 is turned clockwise (as viewed from the outside of the door) the driver 76 is driven clockwise from an initial position where projections 142 are against abutments 138' toward the position illustrated in FIG. 4. As driver 76 rotates, it drives the driven spindle clockwise but the spindle core is not driven. At about the time ribs 142 on the driven spindle 110 reach the abutments 138, the rotation stops 88 limit further rotation of the outside hand lever 72 and driver 76. This prevents ribs 142 from driving spindle core 112, and, through projection 112*a*, driving outer spindle 118 and inside hand lever 104.

When the outside hand lever 72 is released, torsion spring 82 returns the hand lever, driver 76 and driven spindle 110 to their initial positions. As driver 76 is first rotated in one direction and then the opposite direction it drives the latch bolt operating assembly 12 so that latch bolt 13 is first retracted and then extended.

When the inside hand lever 104 is rotated to turn outer spindle 118 clockwise as viewed in FIG. 4, the outer spindle engages projection 112*a* on the spindle core 112 to drive the spindle core. Initially, ribs 142 are against abutments 138' so as the spindle core rotates it causes clockwise rotation of driven spindle 110 and the interior surface of the spindle 110 engages driver 76 so that the driver 76 is rotated to retract latch bolt 13.

When the inside hand lever 104 is released, the torsion spring 82 returns the hand lever 104, driver 76, driven spindle 110, spindle core 112 and outer spindle 118 to their initial positions. As driver 76 is first rotated in one direction and then the opposite direction it drives the latch bolt operating assembly 12 so that latch bolt 13 is first retracted and then extended.

From the foregoing description it is seen that operation of either the inside hand lever 104 or outside hand lever 72 causes rotation of driver 76 and thus retraction of latch bolt 13. However, spindle core 112 and driven spindle 110 uncouple the inside hand lever from the driver 76 when the driver is rotated by the outside hand lever 72. This has the advantage that turning of the outside hand lever does not cause the inside hand lever to turn. As subsequently described, both latch bolt 13 and deadbolt 11 may be retracted by operating the inside hand lever. Since lost motion prevents the outside hand lever from moving the inside hand lever, the outside hand lever cannot be used to retract the deadbolt.

The button bracket 108 is a generally tubular plastic element having two diametrically opposed grooves 150 extending longitudinally along the outer surface of the bracket from the left end as viewed in FIG. 5. The outer diameter of the button bracket varies over its length, increasing from the left end to a first diameter at a point where grooves 150 end. Furthermore, the diameter increases from the right end to a second diameter at the point where grooves 150 end. The second diameter is less than the first diameter so that an axially facing circumferential abutment 152 is formed. The outer periphery of abutment 152 provides minimum surface contact, and thus less friction, between the button bracket 108 and the outer spindle 118 into which it extends.

Button bracket 108 has an internal web or partition 108*a* with a centrally located rectangular opening 108*b* extending through the partition. The opening 108*b* is sized to receive one end of the latch lock bar 74. Web 108 has a cup-shaped or conical surface 108*c* leading to opening 108*b* to aid in guiding the end of lock bar 74 into the opening as the inside and outside chassis assemblies 18, 22 are mounted on the door.

A lock button 154 is mounted on button bracket 108 and extends through an opening 156 in the end face of hand lever 104. The lock button has two axially extending tangs or projections 154*a* which frictionally engage the grooves 150 on the button bracket 108 so the button bracket may be rotated by rotating the button.

When lock button 154 is rotated clockwise as viewed from the inside of the door, button bracket 108 rotates lock bar 74 which in turn rotates the lock plug 71 thereby locking the outside hand lever 72 against rotation. When the outside hand lever is locked, it may be unlocked from the inside of the door by rotating the lock button 154 counter-clockwise, or it may be unlocked from the outside of the door by inserting the key 96 into lock plug 71 and turning the key.

Figure 6:
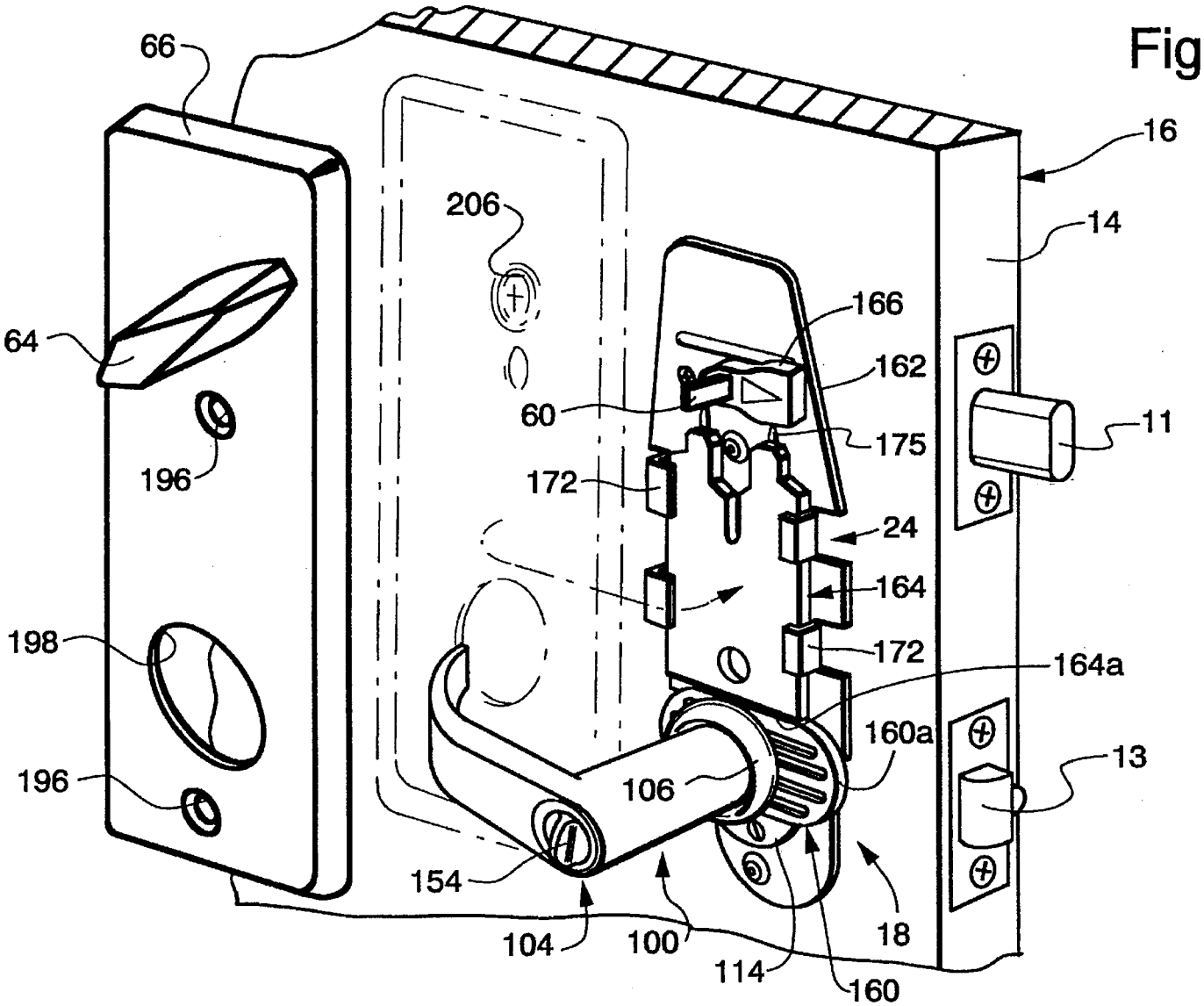
FIG. 6 is a perspective view of an interconnect mechanism for coupling the inside handle to the deadbolt.
Figure 8:
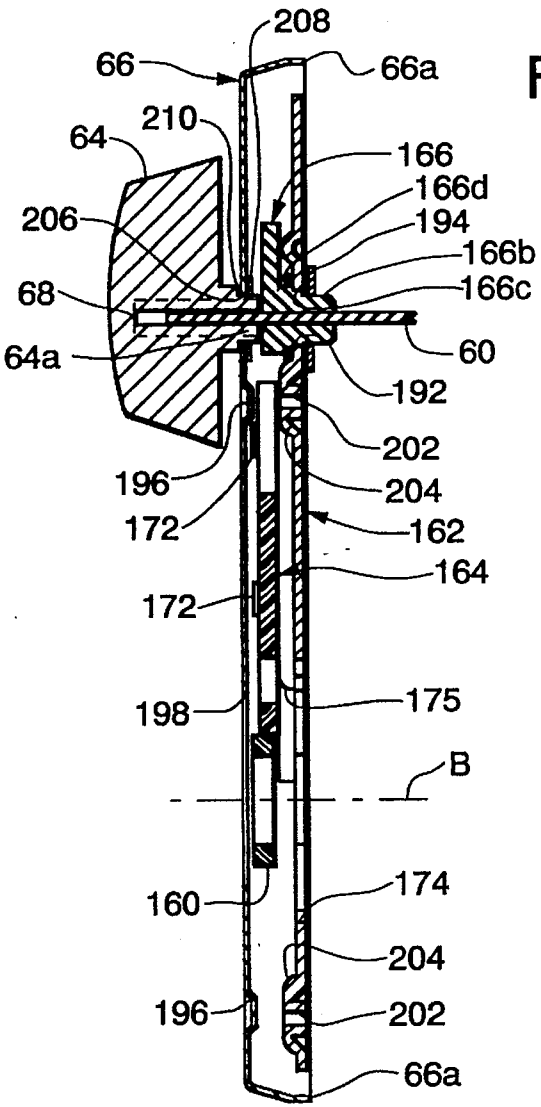
Figure 7:
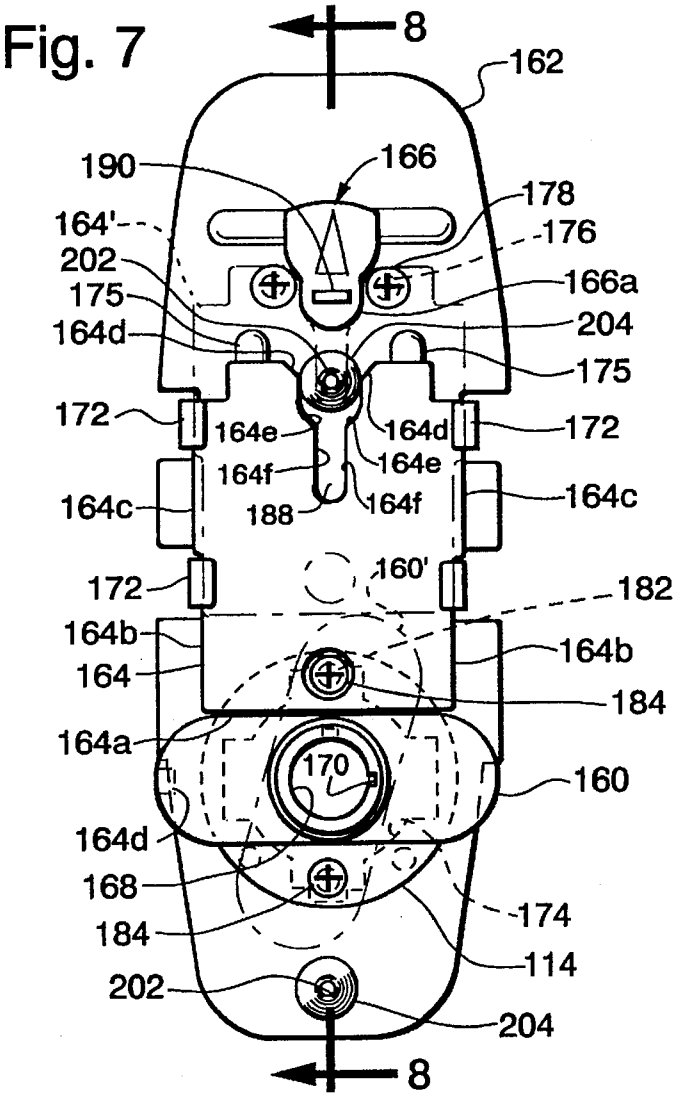
FIG. 7 is a front view illustrating the trim plate and two alternate positions of the lower cam and slide plate of the interconnect mechanism; and, FIG. 8 is a sectional view of the interconnect mechanism taken along line 8—8 of FIG. 7.

In accordance with a second aspect of the invention the lock is provided with an interconnect mechanism 24 as shown in FIGS. 6–8 for interconnecting or coupling the inside chassis assembly 18 to the deadbolt operating assembly 38 so that when the inside hand lever 104 is turned both the latch bolt 13 and deadbolt 11 are retracted into the door. The interconnect mechanism 24 comprises a lower cam 160, a trim plate 162, a slide plate 164, and an upper cam 166.

Lower cam 160 is made of a hard plastic material and has a peripheral camming surface 160*a* in the shape of a rectangle with rounded ends. Cam 160 has a hub 160*b* (FIG. 5) and a central opening 168 (FIG. 7) extends through the hub, opening 168 having a diameter slightly greater than the diameter of outer spindle 118 so that the cam may be mounted on the spindle. Opening 168 is enlarged at one side to receive the hub 114*a* (FIG. 5) of handing plate 114 so that cam 160 may rotate about the hub. A keyway or slot 170 is provided in the wall of opening 168 and the projection 112*a* on spindle core 112 extends into slot 170 as shown in FIG. 5. Because projection 112*a* extends outwardly through slot 120 of the spindle 118 into keyway 170 of the cam 160, rotation of hand lever 104 causes a corresponding rotation of cam 160. As the hand lever 104 turns spindle 118, a side of slot 120 acts against projection 112*a* and projection 112*a* acts against a wall of slot 170 in the cam 160 to rotate the cam about the hub 114*a* of handing plate 114. A circular boss 160*c* is provided on the side of cam 160 facing handing plate 114 to reduce surface contact and friction as the cam rotates relative to the handing plate.

Trim plate 162 is a generally flat plate having a plurality of L-shaped retainer brackets 172 formed by cutting the plate inwardly from its edges, and then bending the cut portions into an L-shape with the free ends of the retainer brackets on opposite sides of the plate facing inwardly toward each other. The brackets 172 retain slide plate 164 but permit free vertical movement of the slide plate relative to trim plate 162.

An opening 174 of irregular shape extends through trim plate 162 and when the trim plate is mounted the center of this opening lies on the axis B about which elements of the inside and outside chassis assemblies rotate. The opening 174 matches the outer periphery of a boss 114*b* (FIG. 3) on the door-facing side of handing plate 114. As the inside chassis assembly 118 is mounted on the door, boss 114*b* fits into opening 174 to insure the proper angular orientation of the chassis assembly and also insure that the axis of the chassis assembly coincides with axis B.

Trim plate 162 has two vertically extending ribs 175 (FIG. 7) and slide plate 164 is freely retained between these ribs and the brackets 172. Ribs 175 serve to reduce the area of contact between slide plate 164 and trim plate 162 thereby reducing sliding friction between the two parts. The trim plate 162 is provided with two countersunk holes 176. Two screws 178 (FIG. 1A) extend through these holes and are screwed into two threaded holes 180 in the deadbolt lock assembly 20 thereby securing the trim plate and deadbolt lock assembly to opposite sides of door 16.

Two further screws 184 (FIG. 1A) extend through countersunk holes 182 in handing plate 114, only one of these holes being visible in FIG. 1A. Screws 184 extend through openings 174 in trim plate 162 and are screwed into threaded holes 186 in housing 80 of the outside chassis assembly. As screws 184 are tightened the housing 80 is drawn into the opening 28 until the large diameter portion 80*a* of the housing engages the outside of door 16. At the same time, handing plate 114 is drawn against trim plate 162 with boss 114*b* (FIG. 3) of the handing plate being aligned with opening 174 (FIG. 7) of the handling plate so that the boss is drawn into the opening. The circular portion of handing plate 114 engages trim plate 162 so that as screws 184 are tightened the handing plate is drawn against the trim plate and the trim plate is drawn against the inside of the door.

Slide plate 164 may be made of a hard plastic material. As shown in FIG. 7, the slide plate has a flat bottom surface 164*a* which normally rests against camming surface 160*a* of lower cam 160. The right and left sides of the slide plate comprise straight line segments 164*b*, 164*c* so that the slide plate may move vertically while being retained by the brackets 172. The upper surface of slide plate 164 comprises two camming surface segments 164*d*, two curved surface segments 164*e* generally matching the contours of the outer periphery of a hub portion 166*a* of upper cam 166, and two generally parallel segments 164*f* which join to form a slot 188.

Upper cam 166 is provided with a rectangular slot 190 which is slightly larger than the deadbolt operating bar 60 and when the deadbolt lock assembly 20 and interconnect mechanism 24 are mounted on the door the operating bar extends through the slot. As best seen in FIG. 8, the hub of upper cam 166 has a first cylindrical portion 166*b* having a diameter smaller than the diameter of a hole 192 provided in trim plate 162 so that portion 166*b* passes freely through the trim plate, a second portion 166*c* having a diameter only slightly smaller than hole 192 so that the hub may rotate in hole 192, and a third portion 166*d* which is slightly larger than the hole so as to abut one side of the trim plate. A spring retainer 194 retains the upper cam 166 on the trim plate.

FIG. 6 shows the position of the various parts when hand lever 104 is in its normal or rest position and the deadbolt 11 and latch bolt 13 are extended. Bottom surface 164*a* of slide plate 164 rests against lower cam 106, and the deadbolt operating bar 60 is vertically oriented so that upper cam 166 extends horizontally in the direction toward the deadbolt. When hand lever 104 is turned counter-clockwise as viewed in FIG. 6, the latch bolt 13 is retracted as previously described. In addition the turning of hand lever 104 rotates lower cam 160 from the position shown in solid lines in FIG. 7 to the position 160' shown in outline. As lower cam 160 rotates, its camming surface presses against the bottom surface 164*a* of slide plate 164 thereby raising the slide plate from the position shown in solid lines to the position 164' shown in outline.

As the slide plate 164 moves upwardly, the camming surfaces 164*d* engage upper cam 166 thereby rotating the cam counter-clockwise from the generally horizontal orientation shown in FIG. 6 to the generally vertical orientation shown in FIG. 7. As upper cam 166 rotates, it rotates the deadbolt operating bar 60. As the deadbolt operating bar rotates, it pivots the deadbolt lever 42 (FIG. 1B) in the deadbolt operating assembly 38 so that slide 46 is moved to the left and deadbolt 11 is retracted within the door.

When hand lever 104 is released, torsion spring 126 returns the hand lever 104 and lower cam 160 to their initial position. Slide plate 164 may or may not move downwardly under the force of gravity at this time. The upper cam 166 remains in the position shown in FIG. 7. Because of the over-center arrangement in the deadbolt operating assembly 10 a rotational force must be applied to operating bar 60 in order to return upper cam 166 to the position shown in FIG. 6. When key 96 is inserted into deadbolt lock assembly 20 and turned to rotate deadbolt operating bar 60, or thumb turn 64 is turned to rotate the operating bar, to again extend deadbolt 11, the upper cam 166 is returned to the position shown in FIG. 6. At this time the upper cam acts first against a camming surface **164*d* and then the top surface of the slide plate 164** to return the slide plate to its initial position in the event it has not already returned to that position under the force of gravity.

Escutcheon plate 66 covers the interconnect mechanism 24. The escutcheon plate is provided with two countersunk holes 196 (FIG. 6) and an opening 198. The escutcheon plate is mounted to the trim plate 162 by two screws 200 (FIG. 1A) which extend through holes 196 and are screwed into threaded holes 202 (FIG. 7) provided in outwardly raised portions 204 of trim plate 162. As shown in FIG. 8, the vertically extending ribs 175 provided on the face of trim plate 162 extend outwardly beyond raised portions 204 so that slide plate 164 slides on the ribs without contacting the raised portions. When screws 200 are tightened, the peripheral edge **66*a* of the escutcheon plate engages the inside of door 16 so that the escutcheon plate encloses, but does not touch, the interconnect mechanism 24**.

The thumb turn 64 is rotatably mounted directly on the escutcheon plate 66. As shown in FIG. 8, thumb turn 64 has a hub **64*a* that extends through a hole 206 in the escutcheon plate. A spring retainer ring 208 retains the thumb turn in the escutcheon plate. The hub 64*a* has an axially facing circular abutment 210 which engages the surface of the escutcheon plate so that the thumb turn is retained in hole 206 by the abutment 210 and retainer ring 208**.

The thumb turn 64 is mounted on escutcheon plate 66 before the escutcheon plate is mounted over the interconnect mechanism 24. The hub **64*a* of the thumb turn is inserted through hole 206 and retainer ring 208 is pressed onto the hub. The escutcheon plate is then turned so that thumb turn 64 is facing door 16. With the escutcheon plate in the position 66' shown in phantom in FIG. 6, the escutcheon plate is moved onto hand lever 104 with the hand lever passing through opening 198** in the escutcheon plate.

Depending on the handing of the door, thumb turn 64 is turned so that one of the crossed slots 68 (FIG. 8) in its hub is aligned with the deadbolt operating bar 60. The escutcheon plate is then moved to the position where its peripheral edge **66*a* contacts door 16 and screws 200 (FIG. 1) are installed thus securing the escutcheon plate and the thumb turn to the trim plate 162 with the deadbolt operating bar extending into one of slots 68**.

It will be noted that by mounting the thumb turn 64 in the manner described above, the thumb turn retaining means, that is retainer spring 208, is concealed between the escutcheon plate and the door and thus cannot be removed unless the escutcheon plate is also removed.

From the foregoing description it is seen that the present invention provides a novel tubular lock interconnect mechanism for interconnecting the latch bolt and deadbolt so that operation of the inside hand lever causes essentially simultaneous retraction of both bolts. A novel lost motion mechanism couples the rotatable latch bolt driver spindle to the inside chassis assembly so that operation of either the inside or outside hand lever rotates the driver spindle to operate the latch bolt, but rotation of the driver spindle is not coupled to the inside chassis assembly.

The invention is adaptable for left or right hand operation and may be used with latch and deadbolt operating assemblies that are adjustable in known manner to provide adjustable back set.

When assembling the lock for use with a right handed door, the driven spindle 110 must (FIG. 4) be positioned with the projections 142 adjacent the abutments 138' at the time the driver 76 is brought into opening 139. On the other hand, for a left handed door projections 142 should be adjacent abutments 138 when driver 76 is inserted into opening 139. When changing handing, each stop 88 (FIG. 1B) must be rotated 180° about an axis extending through the stop normal to the axis of the outside chassis assembly 22. During assembly for either right or left hand operation, the deadbolt 11 should be extended and operating bar 60 oriented vertically at the time the operating bar is inserted through the cam or lever 42. The operating bar 60 should be vertical and the deadbolt extended when the operating bar is inserted through slot 190 in upper cam 166. The cam 166 is oriented so as point toward the deadbolt. Thus, for a left handed door the cam will be oriented so as to point in the opposite direction from that shown in FIG. 6. For left handed use, the spindle and spindle cage are rotated 180° relative to the position shown in FIG. 2B so that the ends **126*a* of the torsion spring engage the two posts shown in FIG. 2B similar to posts 130. Finally, and as well known in the art, the latch bolt operating assembly 12 and deadbolt operating assembly 10 must be rotated 180° in a vertical plane relative to the orientations shown in FIG. 1B at the time they are mounted on operating bar 60 and driver 76** in order to provide left handed operation.

While a preferred embodiment of the invention has been described in detail by way of illustration, it will be understood that various modifications and substitutions may be made in the described embodiment without departing from the spirit and scope of the invention as defined by the appended claims. For example, hand levers 72 and/or 104 may be replaced with handles, knobs or another form of manual actuator. If locking of the latch bolt from the interior of the secured space is not required or is not desirable, the lock button 154 may be eliminated and the lever 104 replaced with a lever or other manual actuator having no hole therein. Similarly, if outside locking/unlocking of the latch bolt is not required, the lock cylinder and plug 70 and 71 may be eliminated. Other modifications will be obvious to one skilled in the art.

We claim:

1. A door lock having a driver rotatable in response to rotation of an inside manual actuator or an outside manual actuator to retract a latch bolt, said door lock comprising:

key-operated lock means for selectively changing the lock between a locked state in which said outside actuator is locked against rotation and an unlocked state in which said outside actuator may rotate, said lock means including clutch means for selectively operatively coupling said outside actuator with said driver in said unlocked state and uncoupling said outside actuator from said driver in said locked state; and, a lost motion means coupling said driver to said inside manual actuator, said lost motion means transmitting rotation movement of said inside actuator to said driver to retract said latch bolt and, when the lock is in the unlocked state, rotate said outside actuator, said lost motion means preventing rotation of said inside actuator in response to rotation of said outside actuator.

2. A door lock as claimed in claim 1 and further comprising a deadbolt and means responsive to rotation of said inside manual actuator for retracting said deadbolt as said latch bolt is retracted.

3. A tubular door lock comprising:

a latch assembly for selectively extending a latch bolt;

a driver for driving said latch assembly;

an outside chassis assembly including an outside housing, an outside spindle mounted in said outside housing for rotation about an axis without axial movement relative to said outside housing, an outside manual actuator fixed to said outside spindle, and, key-operated means for selectively coupling said outside manual actuator to said driver;

an inside chassis assembly including an inside housing, a hollow outer spindle mounted in said housing for rotation about said axis without axial movement relative to said inside housing, an inside manual actuator fixed to said outer spindle for imparting rotational movement thereto, a driven spindle and a spindle core, said driven spindle having an opening therein into which an end of said driver extends, said spindle core being disposed within and operatively engaging said outer spindle so as to rotate therewith, said spindle core having an opening therein in which said driven spindle may freely rotate when said driver is rotated in response to rotation of said outside manual actuator;

at least one projection on said driven spindle and at least one abutment on a wall defining said opening in said spindle core, said abutment and said projection being disposed so that upon rotation of said inside manual actuator said abutment engages said projection to rotate said driven spindle and said driver;

said door lock further comprising a button bracket disposed within said outer spindle, and, a lock bar extending through said driver from said lock means to said button bracket, said button bracket having an opening therein for receiving an end of said lock bar, said opening being configured to the shape of said lock bar whereby, upon rotation of said button bracket in a first or a second direction, said lock means is locked or unlocked.

4. A door lock as claimed in claim 3 wherein an opening is provided in said inside manual actuator for receiving a lock button, said lock button engaging said button bracket whereby rotation of said lock button causes a corresponding rotation of said button bracket.

5. A tubular door lock comprising:

a latch assembly for selectively extending a latch bolt;

a driver for driving said latch assembly;

outside chassis assembly including an outside housing, an outside spindle mounted in said outside housing for rotation about an axis without axial movement relative to said outside housing, an outside manual actuator fixed to said outside spindle, and, key-operated means for selectively coupling said outside manual actuator to said driver;

an inside chassis assembly including an inside housing, a hollow outer spindle mounted in said inside housing for rotation about said axis without axial movement relative to said inside housing, an inside manual actuator fixed to said outer spindle for imparting rotational movement thereto, a driven spindle and a spindle core, said driven spindle having an opening therein into which an end of said driver extends, said spindle core being disposed within and operatively engaging said outer spindle so as to rotate therewith, said spindle core having an opening therein in which said driven spindle may freely rotate when said driver is rotated in response to rotation of said outside manual actuator;

at least one projection on said driven spindle and at least one abutment on a wall defining said opening in said spindle core, said abutment and said projection being disposed so that upon rotation of said inside manual actuator said abutment engages said projection to rotate said driven spindle and said driver;

said door lock further comprising a deadbolt operating assembly for selectively moving a deadbolt between an extended position and a retracted position; and, an interconnect mechanism operatively linking said inside chassis assembly to said deadbolt operating assembly for retracting said deadbolt as said latch bolt is retracted in response to rotation of said inside manual actuator.

6. A door lock as claimed in claim 5 wherein said interconnect mechanism comprises:

a lower cam rotatably driven from said inside manual actuator, an operating bar operatively associated with said deadbolt operating assembly;

an upper cam mounted on an end of said operating bar; and, a slide plate having a lower surface engageable with said lower cam and an upper surface configured to rotate said upper cam from a first position to a second position as said lower cam is rotated to move said slide plate.

7. A door lock as claimed in claim 6 and further comprising a key-operated deadbolt lock assembly, mounted on the outside of a door, for rotating said operating bar whereby said deadbolt may be retracted by a key from outside of a door.

8. A door lock as claimed in claim 6 and further comprising a trim plate adapted to be mounted to a door, said trim plate having a plurality of brackets for confining said slide plate to a linear path of movement.

9. A door lock as claimed in claim 8 wherein said trim plate has a plurality of ridges extending out from a surface facing said slide plate to reduce sliding friction between said trim plate and said slide plate.

10. A tubular door lock comprising:

a deadbolt operating assembly for selectively moving a deadbolt between an extended position and a retracted position;

a latch bolt operating assembly for selectively moving a latch bolt between an extended position and a retracted position;

an inside chassis assembly having an inside manual actuator;

an outside chassis assembly having an outside manual actuator;

a rotatable driver extending between said outside chassis assembly and said inside chassis assembly and operatively associated with said inside manual actuator, said outside manual actuator and said latch bolt operating assembly so that said latch bolt is retracted by rotation of said driver upon rotation of either said inside manual actuator or said outside manual actuator; and, interconnect means responsive to rotation of said inside manual actuator for controlling said deadbolt operating assembly to retract said deadbolt as said latch bolt is retracted;

said inside chassis assembly including a lost motion mechanism between said driver and said inside actuator; said inside chassis assembly and lost motion mechanism transmit rotational movement of said inside actuator to said driver while preventing rotation of said driver in response to rotation of said outside actuator; whereby rotation of said driver in response to rotation of said outside manual actuator does not cause retraction of said deadbolt by said interconnect means.

11. A tubular door lock as claimed in claim 10 wherein said inside chassis assembly includes an outer spindle fixed to rotate with said inside manual actuator and said interconnect means comprises, a lower cam rotatable with said outer spindle;

a trim plate mountable on an inside surface of the door, said trim plate including a plurality of brackets;

a slide plate slidably held by said brackets and disposed to slide relative to said trim plate when acted on by said lower cam; and, an upper cam fixed to a rotatable operating bar that is operatively associated with said deadbolt operating assembly, said upper cam having a first rotational position when said deadbolt is extended and a second rotational position when said deadbolt is retracted, said slide plate having an upper surface for engaging said upper cam and rotating said upper cam from said first rotational position to said second rotational position as said lower cam is rotated.

12. A tubular door lock as claimed in claim 11 wherein said operating bar extends into a key operated deadbolt lock mounted to the outside of the door whereby said deadbolt may be unlocked from outside the door by a key or unlocked from the inside by operation of said inside manual actuator.

13. A tubular door lock as claimed in claim 12 and further comprising a thumb turn having a slot into which an end of said operating bar extends, said thumb turn being accessible from the inside of the door whereby said deadbolt may be extended or retracted from the inside by turning said thumb turn.

14. A tubular door lock as claimed in claim 10 wherein said outside chassis assembly includes a latch bolt lock for selectively locking and unlocking said outside manual actuator against rotation and selectively operatively engaging said outside manual actuator to said driver, and said inside chassis assembly includes a button bracket rotatable by a lock button extending through an opening in said inside manual lever, said lock further including a latch lock bar rotatably driven by said button bracket for locking or unlocking said latch bolt lock.

15. A tubular lock as claimed in claim 10 wherein said inside chassis assembly includes a torsion spring for returning said inside manual actuator to a home position when it is released.

16. A tubular lock as claimed in claim 11 wherein said inside chassis assembly includes a torsion spring for returning said lower cam, said outer spindle and said inside manual actuator to a home position when said inside manual actuator is released.

17. A tubular look as claimed in claim 16 wherein said slide plate returns to a home position under the force of gravity or when said operating bar is turned to extend said deadbolt.

* * * * *